US005333993A

United States Patent [19]

Stueber et al.

[11] Patent Number: 5,333,993

[45] Date of Patent: Aug. 2, 1994

[54] STATOR SEAL ASSEMBLY PROVIDING IMPROVED CLEARANCE CONTROL

[75] Inventors: Henry B. Stueber, Mariemont; Eric E. Baehre, West Chester; Richard W. Albrecht, Fairfield; Christopher C. Glynn, Hamilton; Robert J. Hemmelgarn, Mason, all of Ohio

[73] Assignee: General Electric Company, Cincinnati, Ohio

[21] Appl. No.: 24,581

[22] Filed: Mar. 1, 1993

[51] Int. Cl.[5] ..... F01D 11/02

[52] U.S. Cl. ..... 415/164.5; 415/134; 415/174.1; 415/175; 415/178; 277/26; 277/53; 277/84

[58] Field of Search ..... 415/115, 116, 134, 136, 415/138, 173.1, 173.4, 173.5, 173.7, 174.4, 174.5, 175, 176, 177, 178, 170.1, 173.2, 173.3, 174.1; 277/26, 53, 81 R, 84

[56] References Cited

U.S. PATENT DOCUMENTS 4,397,471 8/1983 Feldman et al. ..... 415/115
4,554,789 11/1985 Napoli et al. ..... 415/116
5,143,512 9/1992 Corsmeier et al. ..... 415/115
5,154,575 10/1992 Bonner ..... 415/173.7

*Primary Examiner*—Edward K. Look
*Assistant Examiner*—Christopher Verdier
*Attorney, Agent, or Firm*—Jerome C. Squillaro; Nathan D. Herkamp

[57] ABSTRACT

A stator seal assembly for a gas turbine engine of a type having a high pressure compressor section and a high pressure turbine section, the stator seal having a seal segment extending between a stator vane support structure and disk seal teeth, the stator seal segment having an arm for forming a cavity, a retaining segment attached to the seal segment and the arm for sealing the cavity to form a dead air space, a control ring located in the cavity having a coefficient of thermal expansion lower than a coefficient of thermal expansion for the seal segment, and a honeycomb pad located between the arm and the seal teeth, whereby thermal expansion clearance between the stator vane and the rotor disk is minimized.

11 Claims, 3 Drawing Sheets

STATOR SEAL ASSEMBLY PROVIDING IMPROVED CLEARANCE CONTROL

BACKGROUND OF THE INVENTION

The present invention relates to gas turbine engines and, more particularly, to aircraft-type high bypass ratio turbine engines having multi-stage compressor and turbine sections.

A typical modern gas turbine aircraft engine, particularly of the high bypass ratio type, includes multi-stage high pressure compressor and turbine sections interconnected by a central compressor shaft or, in some models, a forward shaft. In the later instance, the forward shaft extends between the webs of the last stage high pressure compressor disk and the first stage high pressure turbine disk webs. The high pressure turbine section typically includes first and second stage disks, and the compressor section includes a plurality of disks. Located at the radial end of each disk is a row of rotor blades which together rotate around the compressor shaft between fixed stator vanes.

Stator seals are positioned in the combustor section of the engine, one adjacent to the last stage compressor stator and one adjacent to the first stage turbine stator. These high pressure stator seals are an independent component often made of a low coefficient of expansion material or designed to include a closed cavity. These basic stator seal designs produce an adequate frequency margin, between the natural flexural nodal vibration modes of seal components and corresponding seal rotor speed, however these types of designs result in larger than required thermal expansion clearances, since the stator seal and the rotor seal teeth independently react to thermal conditions generated by the engine.

These undesirably large clearances are the result of thermal expansion mismatch of the stator and rotor structure during both transient and steady state operation of the engine. During transient operation, the stator is influenced by relatively high heat transfer values, whereas the rotor bore is surrounded by lower values. These conditions cause the stator to expand significantly faster than the rotor. During steady state operation of the engine, the rotor bore is bathed in temperatures much lower than the stator. This condition drives the stator to expand to, and remain at, a larger diameter which creates steady state clearances larger than desired. Accordingly, there is a need for a stator seal design which minimizes thermal expansion and mismatch at both transient and steady state operation of the engine, and a design which improves performance of the engine with improved thermal expansion clearance control between the rotor seal teeth and the stator seal.

SUMMARY OF THE INVENTION

The present invention is a high pressure stator seal design for an aircraft-type gas turbine engine. The present invention deters the problems of thermal expansion mismatch of the stator and the rotor structure which causes undesirably large clearances by isolating the deflections of the stator seal from its surrounding environment. The stator seal design includes a seal having a radial box section wherein is located a removable control ring formed from material having a coefficient of thermal expansion which is lower than the remaining stator seal, a dead air cavity, a relatively long shell of revolution forward and aft of the radial box section, and a large thickness of honeycomb pad located below the radial box section.

Isolation of stator seal deflections is accomplished because the control ring, which possesses a lower coefficient of thermal expansion than the seal structure, at a steady state forces the seal down to a smaller diameter. The control ring is removable so that control rings having various coefficients of thermal expansion or various size thermal masses can be utilized to vary stator to rotor clearance if desired. The large thickness of honeycomb isolates the support structure from the very high heat transfer values of the adjacent rotor, which slows thermal response of the seal. The relatively long shell of revolution isolates the critical sealing area from deflections of the support structure, and dissipates axisymmetric deflections imposed on one end of the shell rapidly along the length of the shell. The dead air cavity creates low heat transfer values on the control ring and the remaining seal structure which slows transient thermal growth, and the radial box section provides torsional stiffness and adequate frequency margin.

Accordingly, it is an object of the present invention to provide a stator seal design which improves performance of the turbine engine by providing improved clearance control between the rotor seal teeth and the stator rub land and thus providing reduced parasitic leakage; a stator seal design which includes a control ring having a low coefficient of thermal expansion which can be removed and modified to adjust clearances; and a stator seal design which provides adequate axial support and stiffness, as well as radial restraint.

DETAILED DESCRIPTION

Figure 1:
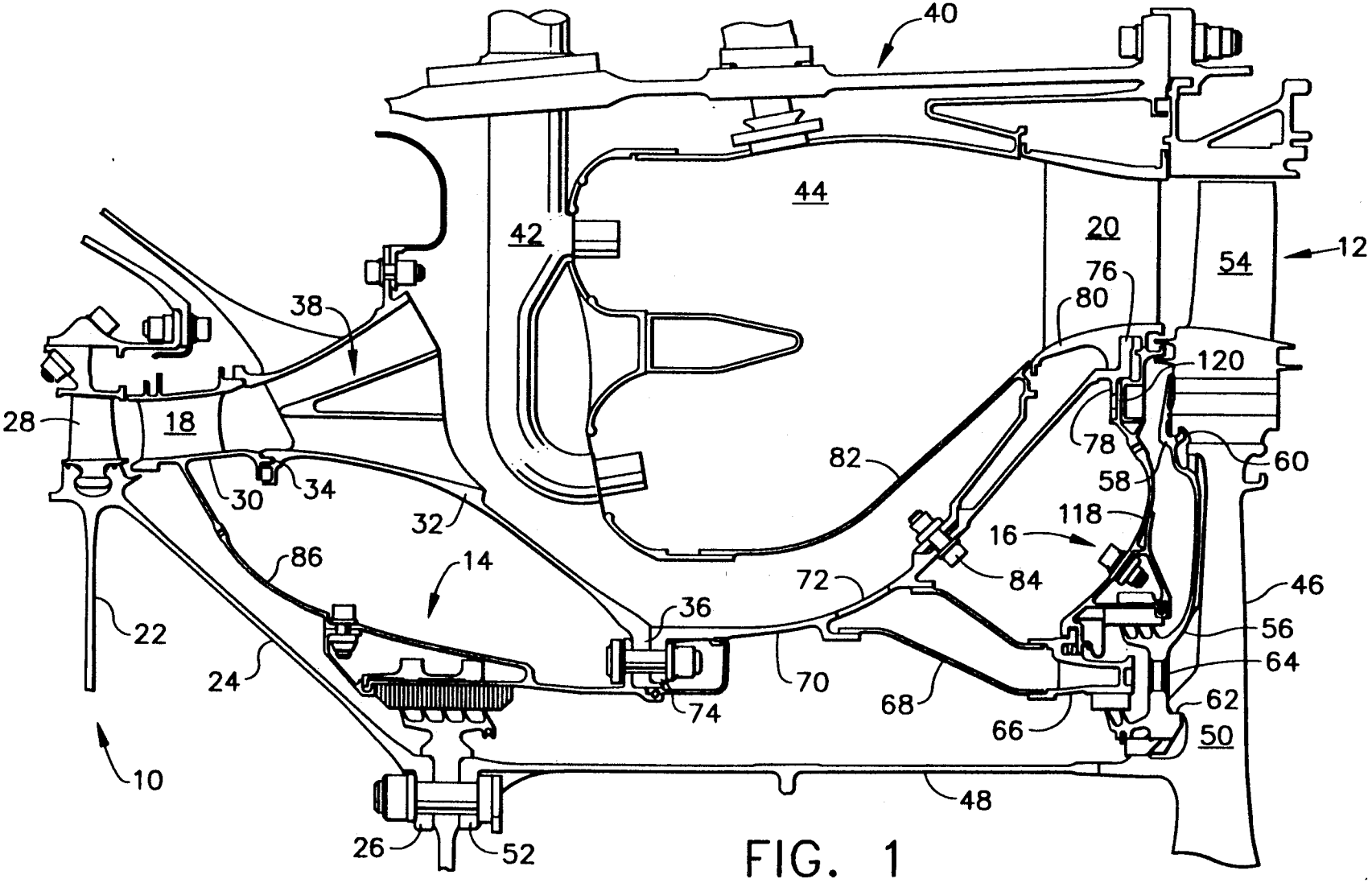
FIG. 1 is a schematic, side elevation of the combustor section of a gas turbine engine embodying the present invention.

As shown in FIG. 1, the present invention includes modifications to the high pressure compressor section, generally designated 10, and high pressure turbine section, generally designated 12, of an aircraft-type high bypass ratio gas turbine engine. Specifically, the invention relates to a stator seal design 14 for the last stage stator 18 in the compressor section 10, and a stator seal 16 for the first stage stator 20 in the turbine section 12.

The high pressure compressor section 10 includes a last stage compressor disk 22 having a rearwardly extending cone 24 which terminates in a flange 26. Mounted in the radially outward end of the last stage compressor disk 22 is a row of rotor blades 28 of which one is shown. Compressor stator 18 is welded to and supported by stator support 30 positioned along the lower surface of stator 18 and extends in an aft direction wherein it is connected to a second stator support 32 by a flanged connection 34. Stator support 32 terminates in an inwardly extending flange 36. Stator support 32 also supports combustor diffuser 38. Combustor diffuser 38 directs compressor air to the combustor 40 wherein it is mixed with fuel supplied by fuel nozzle 42 and ignited in the combustor section 44.

The high pressure turbine section 12 includes a first stage disk 46 which includes a forward shaft 48 which is integral with disk web 50 and terminates in a downwardly extending flange 52. Torque generated by the turbine section 12 is transmitted to the compressor section 10 by forward shaft 48.

Positioned on the radially outward end of first stage disk 46 are a plurality of rotor blades 54, one of which is shown. A forward seal assembly 56 which includes a face plate 58 is connected to the first stage disk 50 by a bayonet connection 60 at a radially outer periphery and a bayonet connection 62 at a radially inner periphery. Seal assembly 56 includes a plurality of axial openings 64 adjacent to the inner periphery which receive cooling air from a stationary, multiple-orifice nozzle 66.

Nozzle 66 includes a forward extending housing 68 which is brazed to the stage one high pressure nozzle support 70. Nozzle support 70 includes a hole 72 to direct air from the combustor diffuser 38 into the nozzle housing 68.

Nozzle support 70 terminates in a forward direction in a downwardly extending flange 74, and in a rearward direction in an outwardly extending flange 76 and a downwardly extending flange 78. Outward extending flange 76 is adjacent stator support 80 which is brazed to the lower surface of turbine stator 20. Nozzle support 70 is also bolted above hole 72 to combustor inner support 82 by bolt 84.

Figure 2:
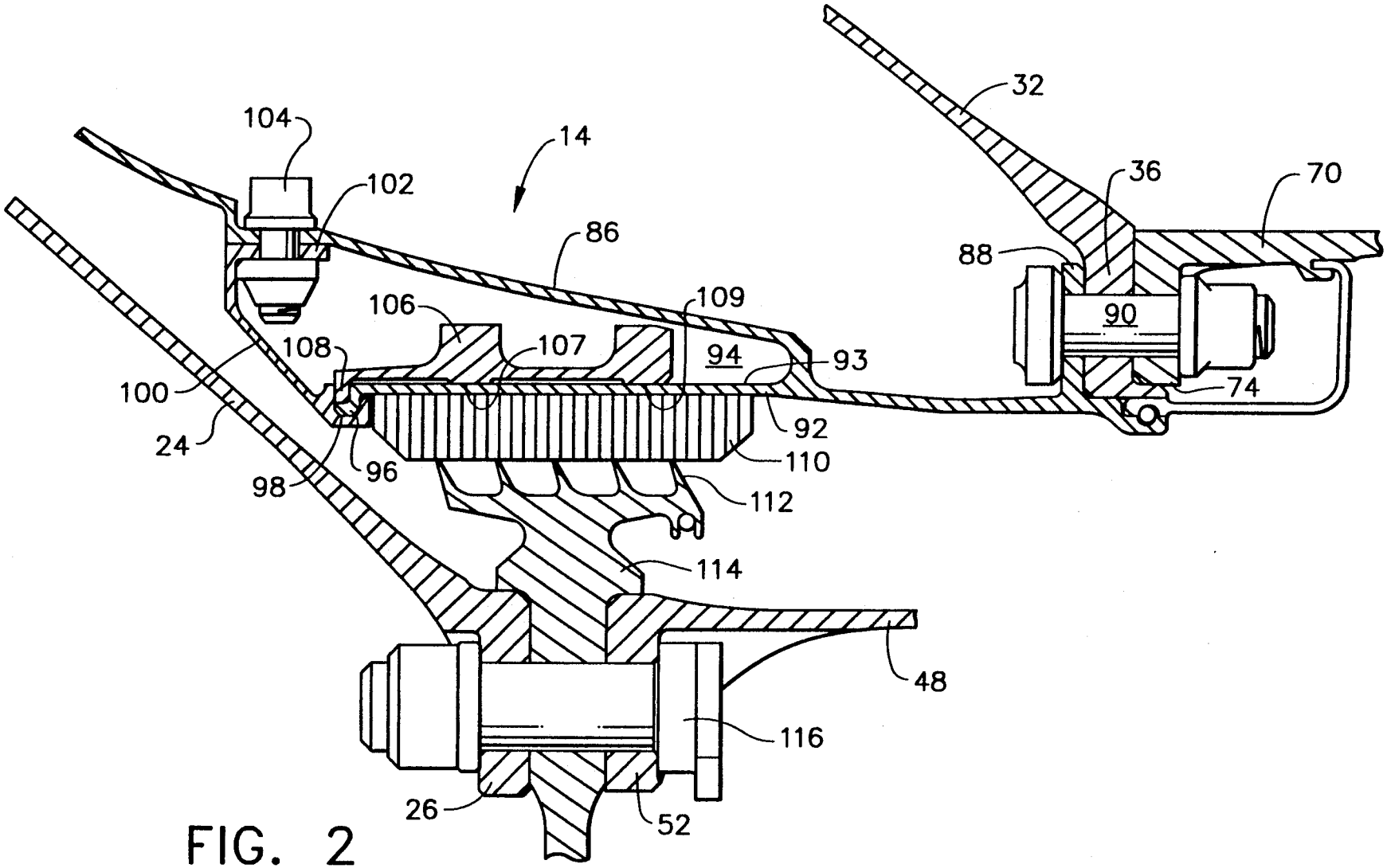
FIG. 2 is a detail of the engine of FIG. 1 showing the stator seal for the last stage compressor stator.

As also shown in FIG. 2, stator seal design 14 for compressor stator 18 includes seal member 86 extending inwardly and rearwardly from stator support 30. Seal member 86 can be made integral with stator support 30 by welding the components together. Seal member 86 terminates in a rearward direction in an outwardly extending flange 88 which is bolted to flange 36 of stator support 32 and flange 74 of nozzle support 70 by bolt 90. Seal member 86 also includes a forwardly extending arm 92 located below seal member 86 for forming a cavity 94.

Forward arm 92 terminates in a downwardly extending flange 96 which is located in a groove 98 formed in retainer section 100. On the opposite end of retainer section 100 is a flange 102 which is bolted to seal member 86 by bolt 104. Retainer section 100 seals the cavity 94, forming a dead air space.

Stator seal design 14 also includes a control ring 106 positioned on forward arm 92 within cavity 94. Control ring 106 is aligned within cavity 94 by a downwardly extending flange 108 which is positioned in groove 98 of retainer piece 100. Control ring 106 includes a pair of axially spaced apart and radially inward lands 107 and 109, with each of lands 107 and 109 directly contacting a radially outward surface 93 of forward arm 92. Control ring 106 is made of a material having a low coefficient of thermal expansion such as Inconel Alloy 909, or Titanium Aluminide; however, any suitable material having a low coefficient of thermal expansion to withstand temperatures up to 1400° F. would be satisfactory.

A honeycomb block 110 is positioned below forward arm 92 and above seal teeth 112 of rotor disk 114. Rotor disk 114 is bolted between flange 26 of cone 24 and flange 52 of forward shaft 48 by bolt 116.

Figure 3:
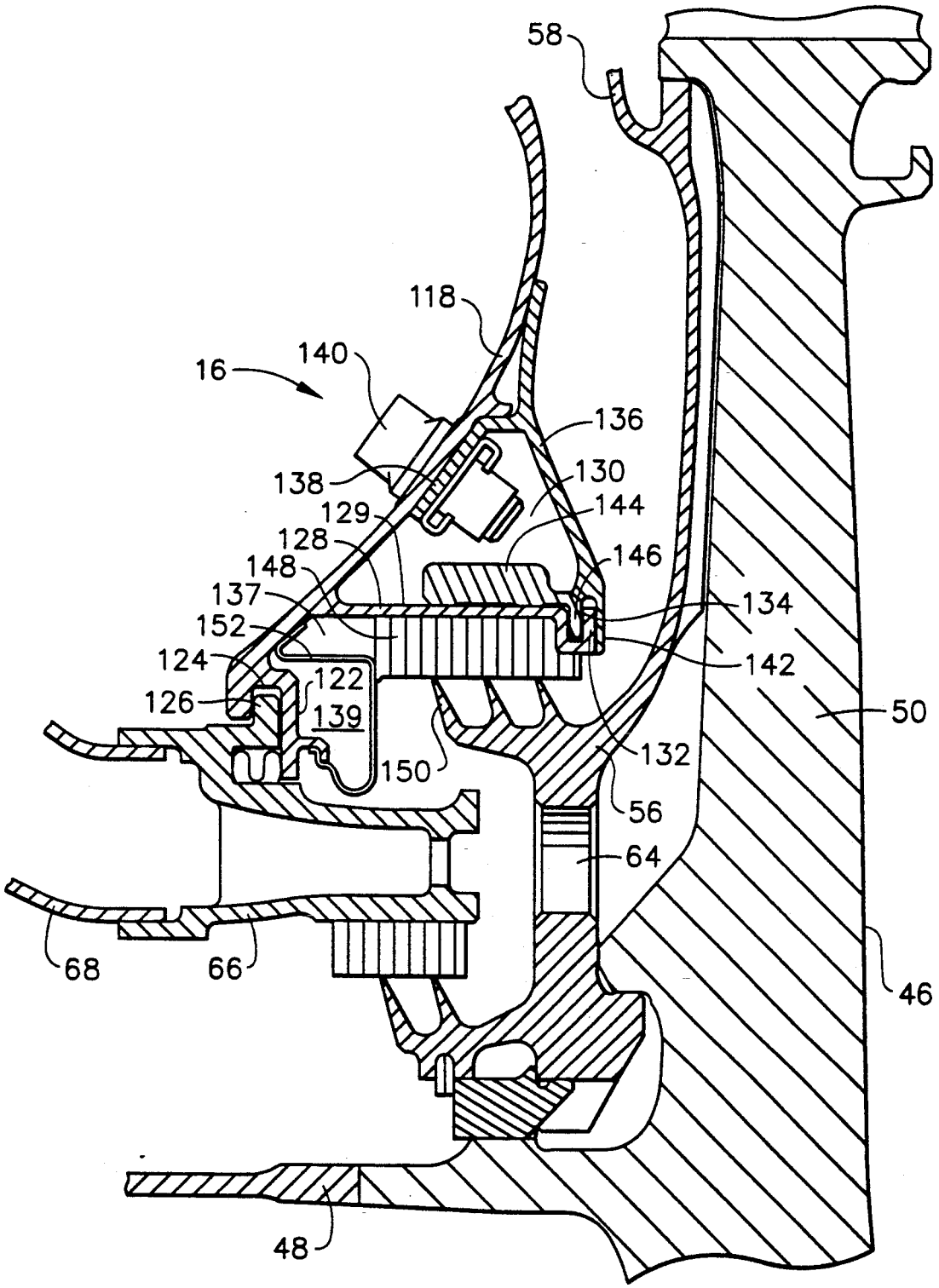
FIG. 3 is a detail of the engine of FIG. 1 showing the stator seal for the first stage turbine stator.

As also shown in FIG. 3, the stator seal design 16 for turbine stator 20 includes a seal member 118 which extends radially outwardly and terminates in a flange 120 positioned adjacent nozzle support flange 78. Support member 118 terminates in a downwardly extending flange 122 which forms a channel 124 for receiving a radially outward extending flange 126 from nozzle 66. Seal member 118 includes an aft arm 128 which forms a cavity 130. Aft arm 128 terminates in an aft direction in a flange 132 which forms a channel 134.

A heat shield/retainer section 136 includes a forward flange 138 for bolting the retainer section 136 to the seal member 118 by bolt 140, and a downwardly extending flange 142 for attachment with aft arm flange 132. Retainer section 136 shields cavity 130 and forms a dead air space. Located within cavity 130 is a low coefficient of thermal expansion control ring 144 positioned on the radially outward surface 129 of aft arm 128. Control ring 144 includes a downwardly extending flange 146 which extends into channel 134 for positioning of the control ring 144.

Located below aft arm 128 is a honeycomb block 148. Honeycomb block 148 is also positioned above seal teeth 150 extending radially outwardly from seal assembly 56. Honeycomb block 148 is positioned axially by aft arm flange 132 and a positioning clip 152. Positioning clip 152 also forms a pair of dead air spaces 137 and 139 below, or radially inward, of aft arm 128.

Stator seal designs 14, 16 improve the engine performance by controlling the clearance between the rotor seal teeth and the stator seals due to thermal expansion. The design controls clearance by isolating deflections of the stator seals 14, 16 from its surrounding environment. Because the control rings 106, 144 possess a lower coefficient of thermal expansion than forward arm 92 and aft arm 128 of seal members 86, 118 respectively, at steady state operation of the engine the control rings force the seal members down to a smaller diameter. The honeycomb blocks 110, 148 are designed to have a larger thickness, at least two to three times the thickness of previous honeycomb blocks, to isolate the forward arm 48 and aft arm 128 respectively from the very high heat transfer values generated by the engine. Seal members 86, 118 provide a relatively long shell of revolution which isolates the critical sealing area from deflections of the stator supports 36, 80, and dissipate the deflections rapidly along the length of the seal members. The dead air space created in cavities 94, 130 create low heat transfer values on the control rings 106, 144 which slows thermal growth. The radial box section formed by seal members 86, 118 and retainer sections 100, 136 provide enhanced torsional stiffness of the seal to provide dimensional and vibrational stability. Additionally, the control rings 106, 144 are removable from cavities 94, 130 so that control rings having different coefficients of thermal expansion or different thermal masses can be substituted to vary clearance values between the stators and rotors if desired.

While the forms of apparatus herein described constitute preferred embodiments of this invention, it is to be understood that the invention is not so limited to these precise forms of apparatus, and that changes may be made therein without departing from the scope of the invention.

What is claimed is:

1. In a gas turbine engine of a type having a high pressure compressor section with a stator vane, said stator vane having a support structure, and a rotor disk, said rotor disk having a plurality of radially-outwardly extending seal teeth, a stator seal assembly comprising:

a stator seal segment extending between said stator vane support structure and said rotor disk seal teeth;

said stator seal segment having a forward arm for forming a cavity;

a retaining segment for sealing cavity to form a dead air space;

a control ring located in said dead air space for controlling thermal growth of said stator seal segment, whereby thermal expansion clearance between said stator vane and said rotor disk is minimized by said control ring at both steady state and during transient operation of said engine;

a relatively thick honeycomb block located between said stator seal forward arm and said rotor disk seal teeth, wherein a radially inward portion of said control ring contacts said forward arm;

wherein said control ring comprises a material having a lower coefficient of thermal expansion than a coefficient of thermal expansion for said seal segment;

wherein said control ring is a titanium aluminide alloy, and wherein said radially inward portion of said control ring comprises a pair of axially spaced apart and radially inward lands, each of said lands directly contacting a radially outward surface of said forward arm.

2. The seal assembly of claim 1 wherein said forward arm and said control ring have means for positioning said control ring within said cavity.

3. The stator seal assembly of claim 1 wherein said control ring is removable to replace said control ring with a control ring having a different coefficient of thermal expansion or a different thermal mass in order to optimally control thermal growth of said stator seal segment.

4. In a gas turbine engine of a type having a high pressure compressor section with a stator vane, said stator vane having a support structure, and a rotor disk, said rotor disk having a plurality of radially-outwardly extending seal teeth, a stator seal assembly comprising:

a stator seal segment extending between said stator vane support structure and said rotor disk seal teeth;

said stator seal segment having a forward arm for forming a cavity;

a retaining segment for sealing said cavity to form a dead air space;

a control ring located in said cavity for controlling thermal growth of said stator seal segment, whereby thermal expansion clearance between said stator vane and said rotor disk is minimized by said control ring at both steady state and during transient operation of said engine;

a relatively thick honeycomb block located between said stator seal forward arm and said rotor disk seal teeth;

wherein said control ring comprises a material having a lower coefficient of thermal expansion than a coefficient of thermal expansion for said seal segment;

wherein said control ring is a titanium aluminide alloy;

wherein said forward arm and said control ring have means for positioning said control ring within said cavity;

wherein said means for positioning said control ring comprises a groove located in said forward arm and a downwardly extending flange from said control ring.

5. In a gas turbine engine of a type having a turbine section with a first state turbine disk having a forward seal assembly, said forward seal assembly including a plurality of radially outwardly extending seal teeth, and a stator vane, said stator vane having a support structure, a stator seal assembly comprising:

a stator seal segment extending between said stator vane support structure and said seal teeth;

said stator seal segment having an aft arm for forming a cavity;

a retaining segment for sealing and shielding said cavity;

a control ring located in said cavity for controlling thermal growth of said stator seal segment, whereby thermal expansion clearance between said stator vane and said turbine disk is minimized by said control ring; and a honeycomb block located between said aft arm and said seal teeth;

wherein said control ring comprises an alloy having a coefficient of thermal expansion lower than a coefficient of thermal expansion of said seal segment;

wherein said control ring is a titanium aluminide alloy;

wherein said aft arm and said control ring have means for positioning said control ring within said cavity;

wherein said means for positioning said control ring comprises a groove located in said aft arm and a downwardly extending flange from said control ring.

6. In a gas turbine engine of a type having a compressor section with a rotor disk and a stator vane, and a turbine section with a stator vane and a turbine disk forward seal assembly, a stator seal assembly comprising:

a first stator seal positioned between said compressor rotor disk and said compressor stator vane;

said first stator having a seal member extending from said stator vane and including means for forming a cavity, means for sealing said cavity, and a control ring positioned in said cavity;

said control ring having a lower coefficient of thermal expansion than a coefficient of thermal expansion of said seal member, thereby controlling thermal growth of said seal member; and a second stator seal positioned between said turbine stator vane and said forward seal assembly;

said second stator seal having a seal member extending from said stator vane and including means for forming a cavity, means for sealing said cavity, and a control ring positioned in said cavity;

said control ring having a lower coefficient of thermal expansion than a coefficient of thermal expansion of said seal member, thereby controlling thermal growth of said seal member;

wherein said means for forming said cavity of said first stator seal is a forward arm, wherein said control ring of said first stator seal includes a pair of axially spaced apart and radially inward lands, each of said lands directly contacting a radially outward surface of said forward arm.

7. The stator seal assembly of claim 6 wherein said means for forming said cavity of said second stator seal is an aft arm and wherein said control ring of said second stator seal is positioned on a radially outward surface of said aft arm.

8. The seal assembly of claim 7 wherein said second stator seal further comprises:

a honeycomb block positioned between said aft arm and said forward seal assembly; and a positioning clip for axially positioning said honeycomb block;

wherein said positioning clip forms a pair of dead air spaces radially inward of said aft arm.

9. The stator seal assembly of claim 6 wherein said first stator seal further includes a honeycomb block positioned between said forward arm and said rotor disk.

10. In a gas turbine engine of a type having a compressor section with a rotor disk and a stator vane, and a turbine section with a stator vane and a turbine disk forward seal assembly, a stator seal assembly comprising:

a first stator seal positioned between said compressor rotor disk and said compressor stator vane;

said first stator seal having a seal member extending from said stator vane and including means for forming a cavity, means for sealing said cavity, and a control ring positioned in said cavity;

said control ring having a lower coefficient of thermal expansion than a coefficient of thermal expansion of said seal member, thereby controlling thermal growth of said seal member; and a second stator seal positioned between said turbine stator vane and said forward seal assembly;

said second stator seal having a seal member extending from said stator vane and including means for forming a cavity, means for sealing said cavity, and a control ring positioned in said cavity;

said control ring having a lower coefficient of thermal expansion than a coefficient of thermal expansion of said seal member, thereby controlling thermal growth of said seal member;

wherein said means for forming said cavity of said first stator seal is a forward arm;

wherein said means for sealing said cavity of said first stator seal is a retainer member fastened to said seal member and said forward arm.

11. In a gas turbine engine of a type having a compressor with a rotor disk and a stator vane, and a turbine section with a stator vane and a turbine disk forward seal assembly, a stator seal assembly comprising:

a first stator seal positioned between said compressor rotor disk and said compressor stator vane;

said first stator seal having a seal member extending from said stator vane and including means for forming a cavity, means for sealing said cavity, and a control ring positioned in said cavity;

said control ring having a lower coefficient of thermal expansion than a coefficient of thermal expansion of seal member, thereby controlling thermal growth of said seal member; and a second stator seal positioned between said turbine stator vane and said forward seal assembly;

said second stator seal having a seal member extending from said stator vane and including means for forming a cavity, means for sealing said cavity, and a control ring positioned in said cavity;

said control ring having a lower coefficient of thermal expansion than a coefficient of thermal expansion of said seal member, thereby controlling thermal growth of said seal member;

wherein said means for forming said cavity of said second stator seal is an aft arm;

wherein said means for sealing said cavity of said second stator seal is a retainer member fastened to said seal member and said aft arm.

* * * * *